US007395568B2

(12) United States Patent
Damewood

(10) Patent No.: US 7,395,568 B2
(45) Date of Patent: Jul. 8, 2008

(54) SELF-CONTAINED ARTICULATED MATTRESS

(75) Inventor: Kevin Damewood, Atlanta, GA (US)

(73) Assignee: Dreamwell, Ltd., Las Vegas, NV (US)

( * ) Notice: Subject to any disclaimer, the term of this patent is extended or adjusted under 35 U.S.C. 154(b) by 0 days.

(21) Appl. No.: 10/660,915

(22) Filed: Sep. 12, 2003

(65) Prior Publication Data

US 2005/0055779 A1 Mar. 17, 2005

(51) Int. Cl.
*A47C 27/00* (2006.01)

(52) U.S. Cl. ..... 5/722

(58) Field of Classification Search ..... 5/613–614, 5/616–618, 722, 933, 690, 694; 297/284.4, 297/284.11, 423.3
See application file for complete search history.

(56) References Cited

U.S. PATENT DOCUMENTS

| | | | | | |
|---|---|---|---|---|---|
| 2,649,595 | A * | 8/1953 | Lewin | 5/616 |
| 4,425,910 | A * | 1/1984 | Meiller | 601/101 |
| 4,965,899 | A * | 10/1990 | Sekido et al. | 297/284.6 |
| 5,174,526 | A * | 12/1992 | Kanigowski | 244/122 R |
| 5,452,868 | A * | 9/1995 | Kanigowski | 244/122 R |
| 5,718,476 | A * | 2/1998 | De Pascal et al. | 297/284.4 |
| 6,106,576 | A * | 8/2000 | Fromson | 318/16 |
| 6,129,419 | A * | 10/2000 | Neale | 297/284.4 |
| 6,460,209 | B1 * | 10/2002 | Reeder et al. | 5/690 |
| 6,754,922 | B2 * | 6/2004 | Dewert | 5/617 |
| 2002/0152552 | A1 * | 10/2002 | Dewert | 5/618 |

FOREIGN PATENT DOCUMENTS

| | | | |
|---|---|---|---|
| JP | 60-45437 | * | 3/1985 |
| JP | 61-36029 | * | 2/1986 |

* cited by examiner

*Primary Examiner*—Sunil Singh
(74) *Attorney, Agent, or Firm*—Ropes & Gray LLP

(57) ABSTRACT

A mattress may include one or more sections movable relative to one another, such as an adjustable head portion or an adjustable foot portion. Motors and/or other drive systems may be integrated within the mattress, and the mattress may be adapted for use with a convention frame or a conventional foundation.

29 Claims, 6 Drawing Sheets

SELF-CONTAINED ARTICULATED MATTRESS

BACKGROUND OF THE INVENTION

1. Field of the Invention

The present invention relates to adjustable mattresses.

2. Description of the Related Art

Conventional adjustable beds, such as fully-articulated hospital beds made by Maxwell and Hill-Rom, generally consist of open steel frames or foundations with articulating arms that move the entire bed platform or portions thereof As a significant disadvantage, these beds are heavy and expensive, making them unsuitable for use by typical consumers.

Adjustable beds have also been introduced into the consumer market. These beds are generally lighter and more compact than hospital beds. However, these mattresses typically require a special foundation designed to support and move a mattress, as well as a specially designed mattress with folding regions corresponding to the moveable areas of the foundation.

There remains a need for an adjustable mattress that can be used with a conventional foundation.

SUMMARY

A mattress may include one or more sections movable relative to one another, such as an adjustable head portion or an adjustable foot portion. Motors and/or other drive systems may be integrated within the mattress, and the mattress may be adapted for use with a convention frame or a conventional foundation.

In one aspect, the invention is an adjustable mattress including a first section and a second section, the first section and the second section moveable relative to each other and together forming at least a portion of a sleeping surface of the adjustable mattress; and a first mechanical drive unit within the adjustable mattress, the first mechanical drive unit connected to at least one of the first section and the second section and providing a mechanical force to move the first section relative to the second section.

The adjustable mattress may also include one or more additional sections, each additional section forming a portion of the sleeping surface of the adjustable mattress, and each additional section moveable relative to at least one of the first section, the second section, or another one of the one or more additional sections. The adjustable mattress may include a second mechanical drive unit within the adjustable mattress and connected to a least one of the additional sections to provide mechanical force to move the at least one of the additional sections relative to at least one of the first section, the second section, or another one of the one or more additional sections. The first mechanical drive unit may be connected to at least one of the one or more additional sections to move the at least one of the one or more additional sections relative to at least one of the first section, the second section, or another one of the one or more additional sections.

The adjustable mattress may include a mattress cover enclosing the first section, the second section, and the first mechanical drive unit. The adjustable mattress may include one or more layers of padding beneath the sleeping surface. The first section may hinge relative to the second section. The adjustable mattress may include a foundation, at least one of the first section or the second section remaining stationary relative to the foundation. Each of the first section and the second section may include a mattress core adapted to receive the first mechanical drive unit. The mattress core of at least one of the first section and the second section may include at least one of a foam core, a liquid core, an air core, a plurality of open spring coils, or a plurality of pocket spring coils.

The adjustable mattress may include a controller adapted to activate the first mechanical drive unit to move the first section relative to the second section. The controller may be wireless. The controller may programmable to recall one or more positions of the first section and the second section. The controller may provide digital adjustment of the first section relative to the second section. The digital adjustment may permit entry of a number characterizing the position of the first section relative to the second section. The controller may provide continuous adjustment of the first section relative to the second section. The continuous adjustment may include at least one of a slider, a knob, or a dial.

The first mechanical drive unit may include one or more of a DC and or AC motor, a worm gear, one or more arms coupled to a DC or AC motor, a cable and a cable winding motor, or a plurality of motors. Each motor may have a thermal hood over the moor and under the mattress upholstery materials.

At least one of the first section and the second section may remain parallel with a ground surface. The first section may be at least one of a head section of a mattress of a foot section of a mattress. The first section may include a rigid sheet for transferring force from the first mechanical drive unit to a bottom surface of the first section.

In another aspect, a method for adjusting a mattress may include providing a first section of the adjustable mattress forming a first portion of a sleeping surface; providing a second section of the adjustable mattress forming a second portion of the sleeping surface; providing a mechanical drive unit that moveably couples the first section to the second section; and activating the mechanical drive unit to move the first section relative to the second section.

In another aspect, an adjustable mattress comprises a first section and a second section, the first section and the second section moveable relative to each other and together forming at least a portion of a sleeping surface of the adjustable mattress; and a mechanical means within the adjustable mattress for moving the first section relative to the second section.

In another aspect, an articulated mattress having a flexible cover, includes a base element having a head end forming a planar region parallel to the sleeping surface of said mattress, a sleeping element including: one or more mattress cores disposed on and above a flexible platform; and articulation means fixedly attached to said base element, comprising a screw drive means fixedly mounted to said base element; and linkage means coupled to said screw drive, whereby actuation of said screw drive causes said linkage to bear on said flexible platform, thereby displacing said platform; and wherein said base element, said sleeping element, and said articulation means are located within said flexible cover.

The mattress may overlap a frame, the mattress further comprising one or more clamping means for attaching said mattress to said frame. The articulation means may further include a controller configured to effect said actuation. The controller may be a wireless controller.

In another aspect, an articulated mattress having a flexible cover may include a base element forming a planar region parallel to the sleeping surface of said mattress and having a head end; a head armature having a proximate end and a distal end, said proximate end rotatably connected to said base element at said head end and disposed to rotate said distal end out of said planar region; and motor means fixedly mounted to said base element and rotatably coupled to said head armature whereby actuation of said motor means causes rotation of said distal end of said armature; wherein said base element, said head armature, and said motor means are located within said flexible cover.

The motor means may further include a stator portion fixedly attached to said base element; a rotor portion disposed to rotate upon said actuation of motor means; and an axle fixedly connected to said rotor portion; wherein said axle is fixedly connected to said proximate end of said head armature. The motor means may include a stator portion fixedly attached to said base element; cable winding means attached to a rotor portion of said motor; a first fixed sheave mounted on said base element; a second fixed sheave mounted on said head armature; and a length of cable having a proximate end and a distal end; wherein: said proximate end of said cable is fixedly attached to said winding means; said cable is wrapped at least partly around said winding means, passing thence around said first fixed sheave in a first direction and then around said second fixed sheave in a second direction; and said distal end of said cable is fixedly attached to said head armature so that actuation of said motor means causes said distal end of said cable to be drawn towards said winding means, thereby rotating said head armature out of said planar region.

The mattress may include a bottom surface disposed opposite said sleeping surface; and said base element and said head armature are disposed between said sleeping surface and said bottom surface parallel to said bottom surface. The articulated mattress may further include one or more flexible mattress cores disposed between said sleeping surface and said base element and between said sleeping surface and said head armature.

The motor means may include: a stator portion fixedly attached to said base element; cable winding means attached to a rotor portion of said motor; a first fixed sheave mounted on said base element; a second fixed sheave mounted on said head armature; and a length of cable having a proximate end and a distal end; wherein: said proximate end of said cable is fixedly attached to said winding means; said cable is wrapped at least partly around said winding means, passing thence around said first fixed sheave in a first direction and then around said second fixed sheave in a second direction; and said distal end of said cable is fixedly attached to said base element so that actuation of said motor means causes said distal end of said cable to be drawn towards said winding means, thereby rotating said head armature out of said planar region. The motor means may include a plurality of identical motors acting in concert. The motor means may include a controller configured to effect said actuation. The controller may be a wireless controller.

In another aspect, an articulated mattress having a flexible cover may include a base element forming a planar region parallel to the sleeping surface of said mattress and having a foot end; a foot armature having a proximate end and a distal end, said proximate end rotatably connected to said base element at said foot end and disposed to rotate said distal end out of said planar region; and motor means fixedly mounted to said base element and rotatably coupled to said foot armature whereby actuation of said motor means causes rotation of said distal end of said armature; wherein said base element, said foot armature, and said motor means are located within said flexible cover.

The motor means may further include a stator portion fixedly attached to said base element; a rotor portion disposed to rotate upon said actuation of motor means; and an axle fixedly connected to said rotor portion; wherein said axle is fixedly connected to said proximate end of said foot armature. The motor means may include: a stator portion fixedly attached to said base element; cable winding means attached to a rotor portion of said motor; a first fixed sheave mounted on said base element; a second fixed sheave mounted on said foot armature; and a length of cable having a proximate end and a distal end; wherein: said proximate end of said cable is fixedly attached to said winding means; said cable is wrapped at least partly around said winding means, passing thence around said first fixed sheave in a first direction and then around said second fixed sheave in a second direction; and said distal end of said cable is fixedly attached to said foot armature so that actuation of said motor means causes said distal end of said cable to be drawn towards said winding means, thereby rotating said foot armature out of said planar region.

The mattress may include a bottom surface disposed opposite said sleeping surface; and said base element and said foot armature may be disposed between said sleeping surface and said bottom surface parallel to said bottom surface. The mattress may further include one or more flexible mattress cores disposed between said sleeping surface and said base element and between said sleeping surface and said foot armature. The motor means may include a stator portion fixedly attached to said base element; cable winding means attached to a rotor portion of said motor; a first fixed sheave mounted on said base element; a second fixed sheave mounted on said foot armature; and a length of cable having a proximate end and a distal end; wherein: said proximate end of said cable is fixedly attached to said winding means; said cable is wrapped at least partly around said winding means, passing thence around said first fixed sheave in a first direction and then around said second fixed sheave in a second direction; and said distal end of said cable is fixedly attached to said base element so that actuation of said motor means causes said distal end of said cable to be drawn towards said winding means, thereby rotating said foot armature out of said planar region.

The motor means may further include a plurality of identical motors acting in concert. The motor means may include a controller configured to effect said actuation. The controller may be a wireless controller.

BRIEF DESCRIPTION OF THE DRAWINGS

The present disclosure may be better understood and its numerous features and advantages made apparent to those skilled in the art by referencing the accompanying drawings.

FIG. 3A is a side view; FIGS. 3B and 3C are top views; and FIG. 3D is a cut-away isometric view.

The use of the same reference symbols in different drawings indicates similar or identical items.

DETAILED DESCRIPTION

Figure 1A:
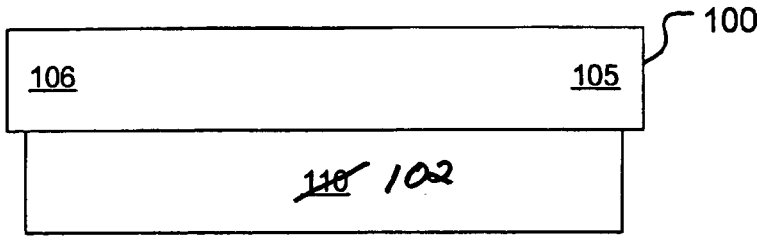
FIGS. 1A-1D illustrate several side views of an adjustable mattress according to a preferred embodiment of the present invention.
Figure 2:
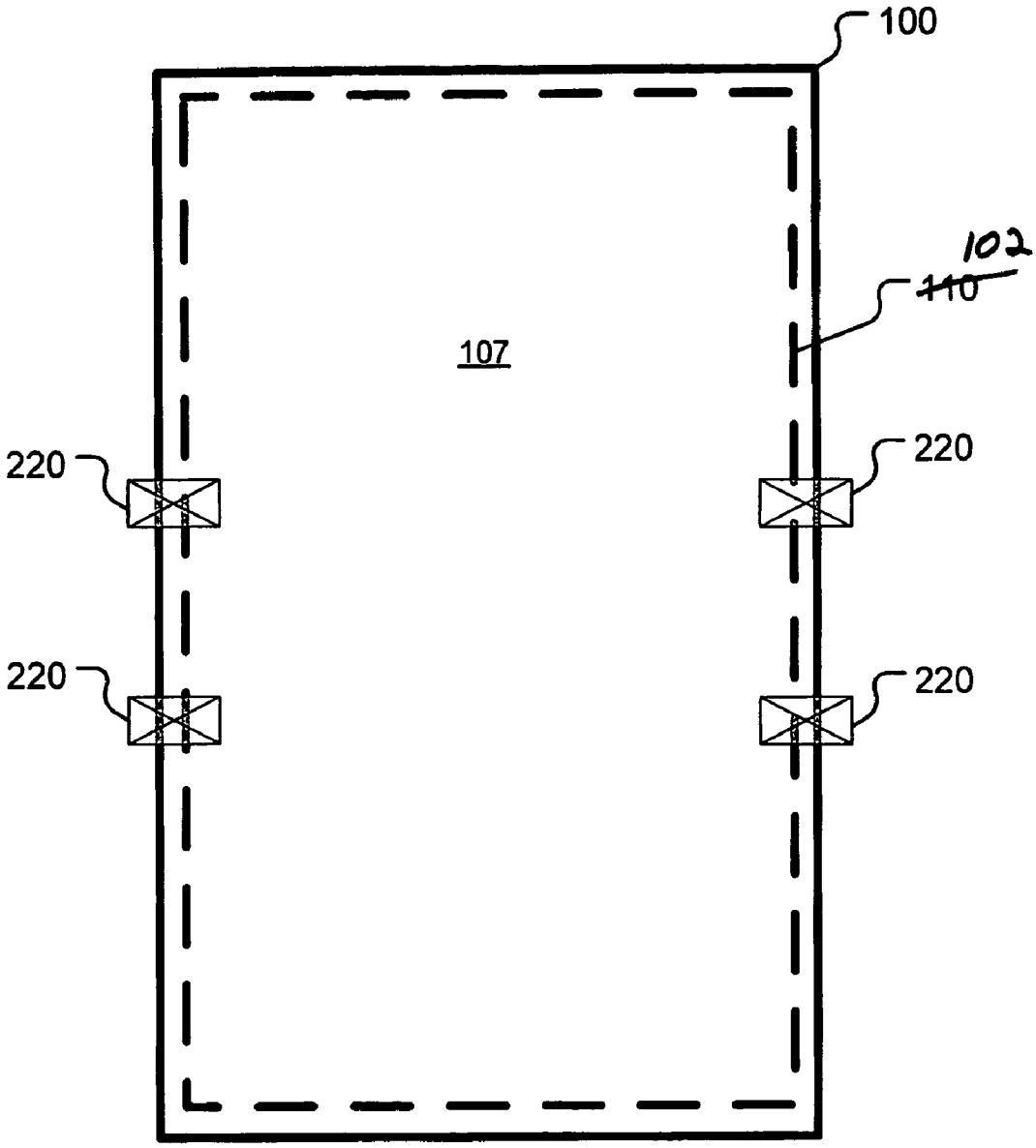
FIG. 2 is a top view of an adjustable mattress according to one embodiment of the present invention.

Described herein is an adjustable mattress having a sleeping surface elevation actuation mechanism fully enclosed within the mattress 100, which then fits directly onto a conventional bed frame or foundation 102 so that, when the bed is in a flat or "down" position, it looks just like a conventional mattress or bed. This configuration is shown in FIG. 1A. The mattress 100 may, in some embodiments, extend beyond (over) all four sides of frame 102, as shown from a top-down perspective in FIG. 2. Furthermore, mattress 100 may be temporarily or releasably attached to frame 102 by one or more conventional attachment devices 220, such as C-clamps or hook & loop type fasteners.

In the embodiment of FIG. 1, a first section, the head 105 and/or a second section, the foot 106 of the mattress 100 can be raised independently of the rest of the sleeping surface or one another. This articulated mattress, which includes a movable joint between otherwise rigid sections, shows one manner in which the mattress may be adjustable. FIGS. 1B through 1D show an example of this articulation.

Figure 1B:
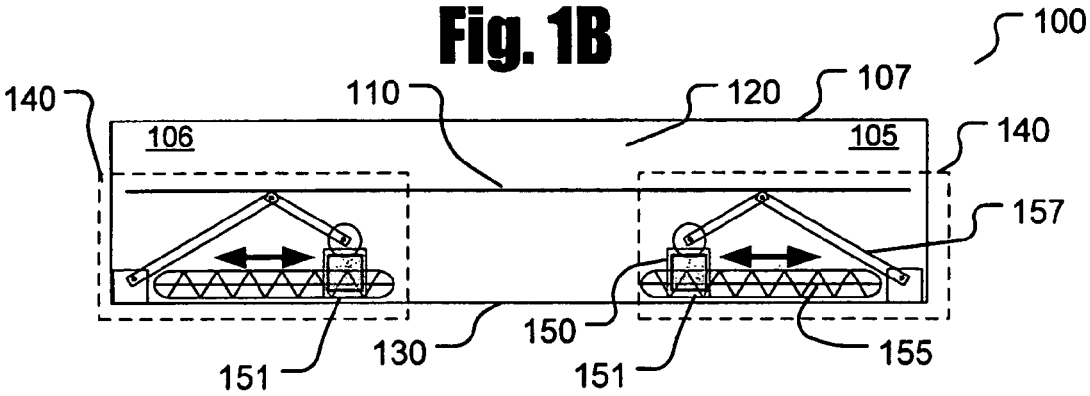

FIG. 1B shows the mattress 100 in a flat or "down" position. The sleeping surface 107 of the head 105, the foot 106, and the center of the mattress 100 are coplanar. As seen in this side view, the interior of the mattress 100 may include a flexible mid-sheet 110 constructed of conventional sheet material, such as a ⅛-inch thick piece of plywood or plastic. A hinge or pliable joint may interconnect one or more regions of the mid-sheet 110 where the mattress 100 is to be folded, with the force applied by one or more mechanical drive units 140 distributed across each region by a corresponding region of the mid-sheet 110.

The mid-sheet 110 supports the mattress core 120, which may consist of one or more layers of latex foam or other conventional mattress components such as open coils, pocket coils, water or other liquid, air, or a combination of these, as well as a mattress topper, a quilted exterior surface, padding, waterproof liners, breathable liners, or any other mattress components and materials, or combinations thereof. The mid-sheet 110 may be sized to match the sleeping surface and the corresponding outer perimeter dimensions of core 120.

The non-sleeping surface of the mattress 100, the bottom 130, may include a rigid platform or other planar structure, such as one or more sheets of plywood, metal, solid wood, stiff members, plastic, or an "egg crate" type plastic platform, or any combination of these. (See FIG. 1B). Mounted on the bottom 130 may be one or more mechanical drive units 140, each of which may include a motor 150 having an optional thermal motor hood 151, and being connected to, for example, a horizontal screw or a worm drive shaft 155. Operation of the motor 150 causes the screw 155 to rotate, either compressing or extending a linkage 157. When the linkage 157 is compressed, a hinge point in the linkage may force a portion of the mid-sheet 110 upward, thus raising an end of the mattress (for example, the head end 105 in FIG. 1B). The thermal motor hood 151 depicted in FIG. 1 fits over the motor 150 and provides a thermal barrier between the motor 151 and the upholstery materials in the mattress. The thermal hood 151 may be any suitable thermal barrier capable of preventing the material in the mattress from heating to a temperature above an acceptable range. In one embodiment, the thermal hood 151 includes an aluminum shell with a fiberglass lining and prevents the mattress from developing a hot spot that the occupant may find undesirable and that may damage the foam or materials in the mattress.

One of ordinary skill in the mechanical arts will readily appreciate that many variations on a conventional screw drive are useable with the mattresses described herein. For example, screw drives wherein a fixed motor rotates the screw and causes a traveler to move along the screw may also be used to articulate the linkage. Furthermore, various single- or multi-element linkages may be used to translate the linear motion provided by a screw drive and traveler into the necessary elevation of a portion of mid-sheet 110. These and other configurations for converting the mechanical force of a motor into a force of a desired direction and strength may be suitably adapted to the systems described herein, provided they may be accommodated within a mattress.

For example, in an embodiment, the screw 155 may be fixedly mounted to the bottom 130 at both ends and in such a way that it cannot rotate about its length. A motor may then be located in a traveler assembly such that actuation of the motor causes it and the traveler to move along the screw together. The linkage 157 may be attached to the traveler or simply pushed along a guide way by the motor/traveler assembly.

The motor 150 may be any conventional direct current (DC) motor, sized appropriately for the expected the weight of the sleeper and the friction losses inherent in a screw/linkage system. Such motor sizing calculations, including determination of sleeper loads and the mechanical efficiency (or lack thereof) of a screw 155, associated gearing systems (if required), and linkage 157 are well-within the skill of an ordinary practitioner in the mechanical arts.

Figure 1C:
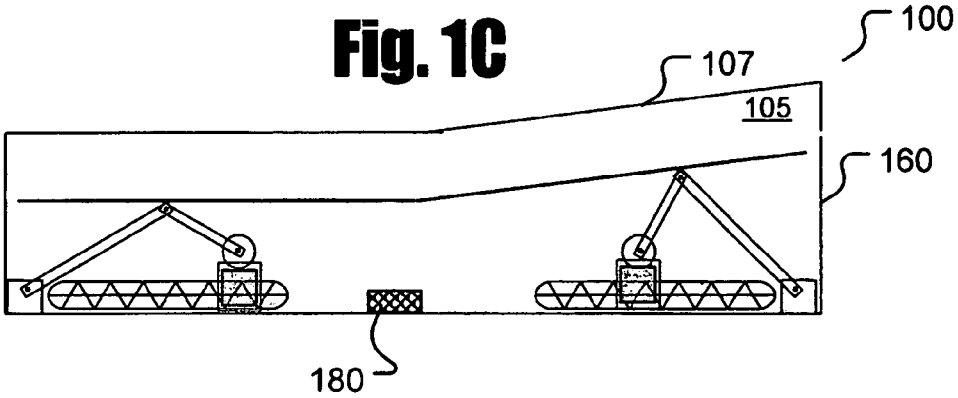
Figure 1D:
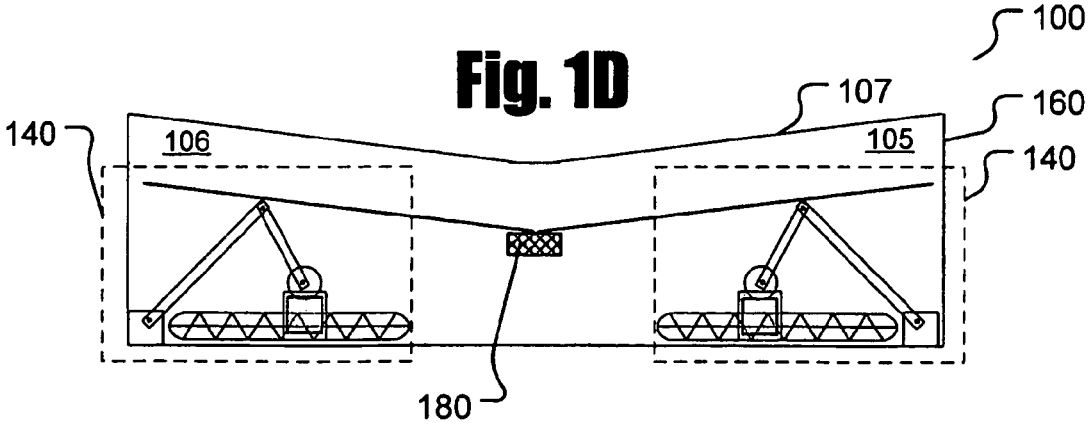

FIG. 1C shows the mattress 100 with the head end 105 raised. The mattress cover 160 may expand as shown to allow for the movement of the head end 105. Likewise, as depicted in FIG. 1D, the foot end 106 may be raised using a second mechanical drive unit 140. Again, the mattress cover 160 may expand at the foot end of mattress 100 to accommodate the raising of the foot end 106.

In some embodiments, the mattress 100 may also include within its cover 160, and mounted, for example, to the bottom 130, a vibrator or massager unit 180 (see FIG. 1C). Alternately, vibrator 180 may be mounted to the mid-sheet 110, as illustrated in FIG. 1D. Other devices, such as a heater, may similarly be included.

It will be appreciated that the mattress 100 may include a number of additional moveable sections, some of which may remain stationary relative to a foundation or parallel to the ground, while others may shift in orientation, or rise or lower according to user-selected inputs. All such configurations, along with any additional drive units and other hardware, are intended to fall within the scope of the systems described herein.

FIG. 3 shows two alternate forms of the mechanical drive unit 140. In side view FIG. 3A and top view FIG. 3B, a stator portion of a motor 310 is mounted to a base unit 320. A rotor portion of the motor 310 is attached to an armature 330 through flanges 335 and an axle 340. The outside ends of the axle 340 may be supported by pillow blocks or other conventional bearing means 350 (shown in top view in FIG. 3B) at the outer ends of the base 320.

Figure 3A:
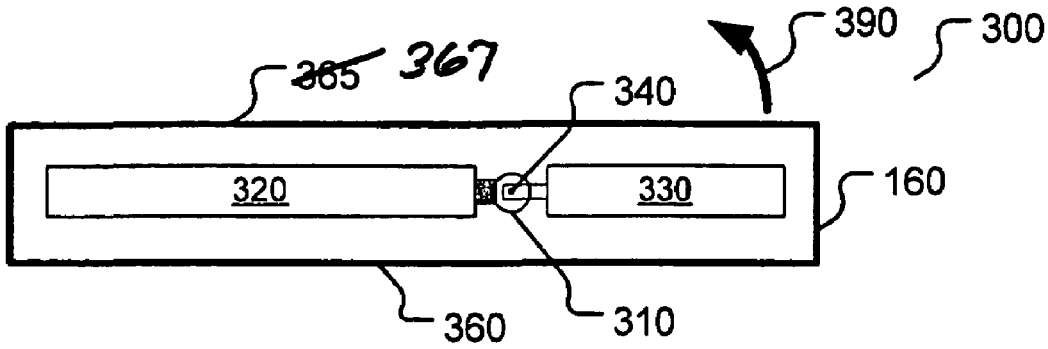
FIGS. 3A-3D illustrate several views of an adjustable mattress according to some alternate embodiments of the present invention. In particular.
Figure 3B:
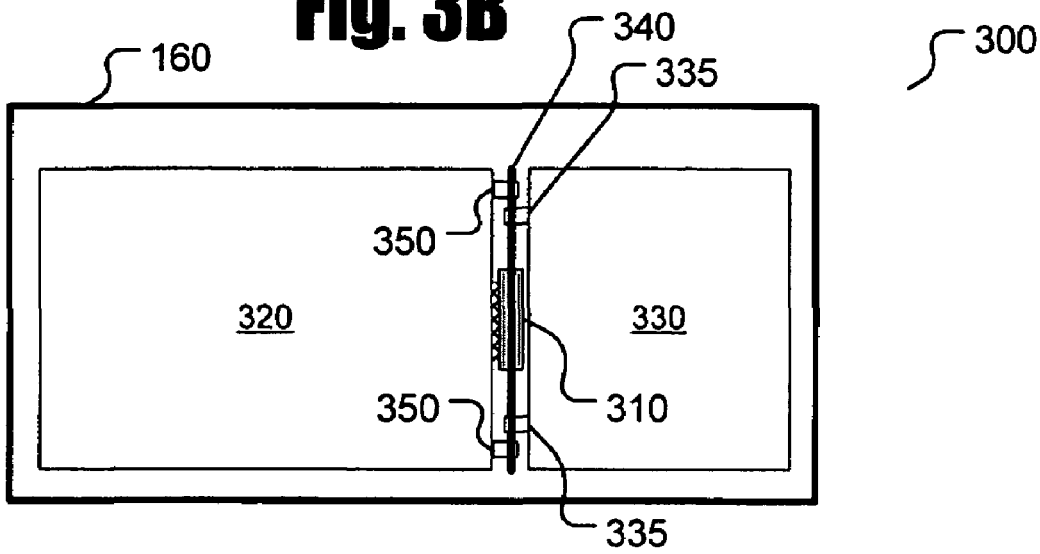
Figure 3C:
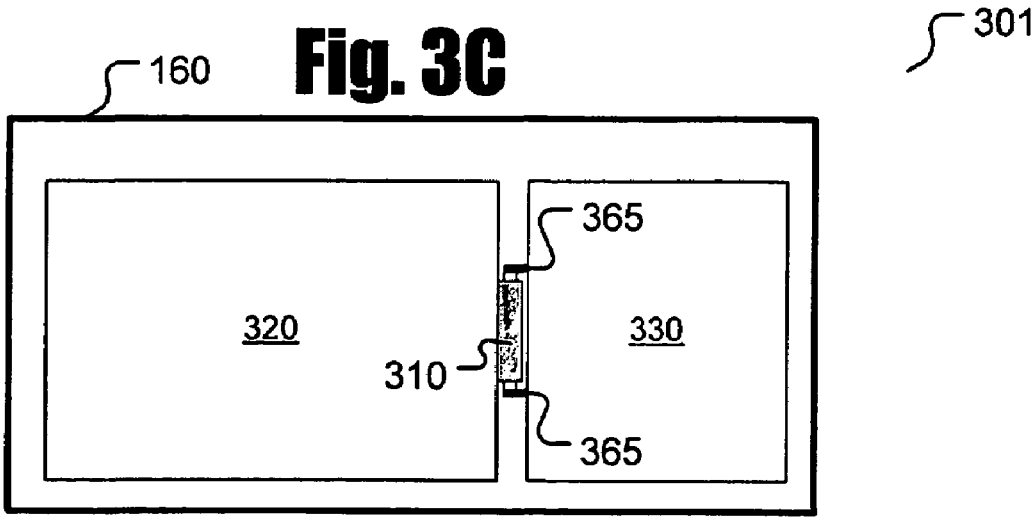
Figure 3D:
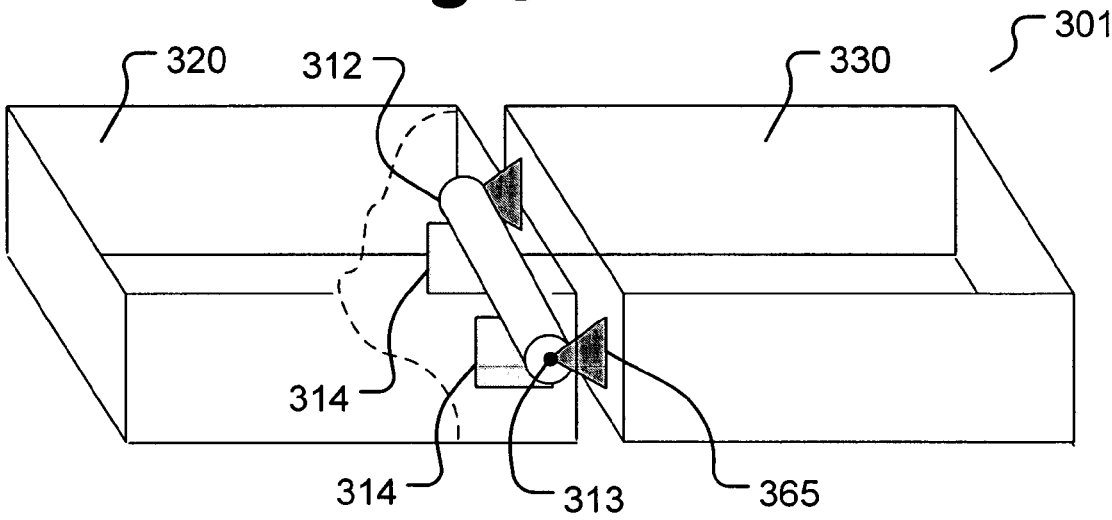

In a further alternative embodiment, the rotor portion 313 of the motor 310 is directly attached to the armature 330 through a flange 365 or other conventional fixed attachment, as shown in FIGS. 3C and 3D. The stator (non-moving) portion 312 of motor 310 is attached to the base 320 using one or more conventional motor mounts 314.

The base 320 may be permanently mounted directly to the bottom surface 360 of the mattress 300 (referring to FIGS. 3A and 3B) or 301 (referring to FIGS. 3C and 3D), or it may be mounted on a sub-structure (not shown) parallel to but not in direct contact with the inside of bottom surface 360. The cover 160, wrapping all the way around the mattress 300 and forming both a sleeping surface 367 and a bottom surface 360, may then encompass conventional padding or ticking in the interior space between the base 320 (and/or any sub-structure) and the cover 160. Alternatively, the base 320 may form at least a part of the bottom surface 360, with the balance of that surface (if any) formed from rigid panels attached to and surrounding the base 320. Such bottom panels (not shown), together with the base 320, may thus form a type of mattress bottom as commonly seen in "no-flip" mattress styles. The cover 160 may then encompass all surfaces, as noted above, or be attached only at the perimeter of the bottom surface 360, thereby leaving the bottom surface 360 uncovered.

In operation, when the motor 310 is actuated, the torque produced on the rotor 313 (FIGS. 3C and 3D) or the axle 340 (in FIGS. 3A and 3B) will cause the armature 330 to lift up, toward the sleeping surface 367 (shown by an arrow 390 in FIG. 3A), thus elevating a corresponding portion (e.g., head or foot) of the mattress. The armature and motor assemblies 330, 310 (including the appropriate axle, bearing, and/or flange elements) could be mounted on either end of the base 320, allowing for movement of both the head and/or foot portions of the mattress 300.

In yet another embodiment, a mattress sized to accommodate two people may have a four armature assemblies, two for the heads and two for the foots, to enable independent adjustment within a single flexible mattress envelope or covering.

Generally, any combination of motors, actuators, levers, arms, worm gears, travelers, pulleys, tracks, hinges, springs or other mechanical hardware may be employed in the mattresses described herein, provided they collectively have a size suitable for containment within a mattress and a strength adequate to support the mattress and one or more associated sleepers. For example, the mechanical drive unit may be placed below the mattress core, which has a relatively rigid bottom as described above, or the mechanical drive unit may be placed within the mattress core, which may be adapted to receive a motor, arms, and other hardware to adjustably move portions of the mattress. Further, while electrical motors have been noted throughout this description, other means of initiating mechanical force may be employed such as pneumatic or hydraulic cylinders. Similarly, a mattress as described herein may include a manually activated adjustment, such as a foot pedal or hand crank, either as a back-up to an electromechanical system or as the exclusive means for adjusting the mattress to an appropriate position. In this respect, a spring assisted lever arm may be provided for manually changing between a flat configuration and an inclined configuration. This latter operation will be readily familiar to anyone who has used a reclining chair with a lever that is operated to elevate a foot rest and recline the chair back, and techniques for adapting such a system to the adjustable mattress described herein will be readily apparent to one of ordinary skill in the art.

Figure 4:
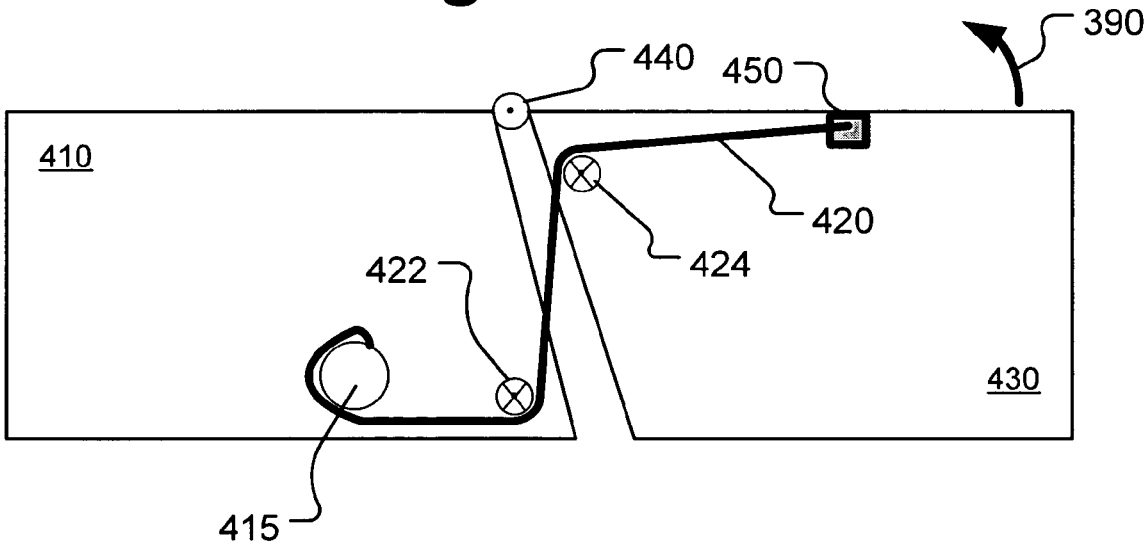
FIG. 4 is a side view of a portion of a cable-driven, adjustable mattress, according to an alternate embodiment of the invention.
Figure 5:
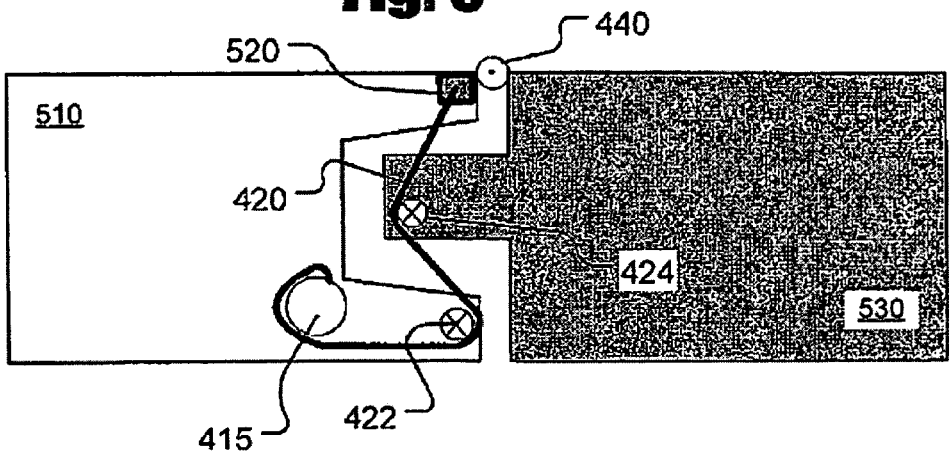
FIG. 5 is a side view of a portion of another embodiment of a cable-driven, adjustable mattress.

FIGS. 4 and 5 show two side views of a cable-driven adjustable mattress. As above, a motor 415 (such as a conventional DC motor) may be mounted to the base element 410, a portion of which is shown in FIG. 4. A cable 420, wound at least partly around and secured to the rotor portion of the motor 415, passes around two sheaves 422 and 424 and may be attached to an armature 430 at an attachment point 450. When the cable 420 is retracted (wound up) on the motor 415, the armature 430 is driven upward, rotating around the hinge 440 in the direction of an arrow 490.

In an embodiment of the adjustable mattress, the cable 420 may be attached to a point 520 in a base element 510, as shown in FIG. 5. Although an armature 530 in this embodiment has a slightly different configuration, the principle of operation of the cable drive mechanism in both FIGS. 4 and 5 will be familiar to a practitioner of ordinary skill in the mechanical arts.

Figure 6:
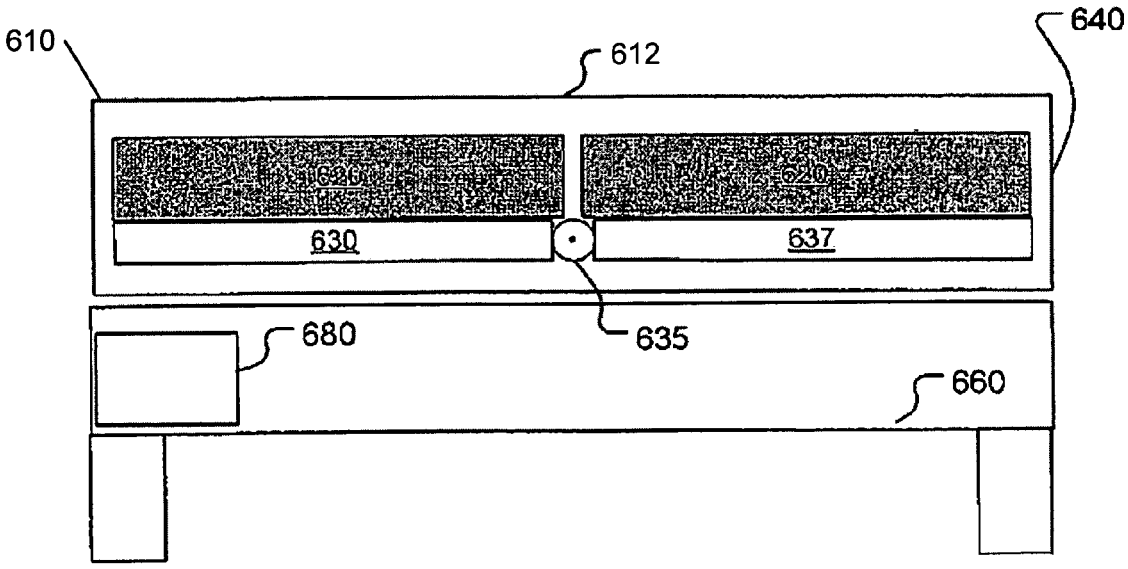
FIG. 6 is a side view of an adjustable mattress, according to some embodiments of the present invention, illustrating the location of the mattress core(s) relative to the base 630, armature 637, and actuators 635; and being disposed on a foundation 660 having a battery power supply 680.

FIG. 6 shows a side view of an adjustable mattress. A sleeping surface 612 of a mattress 640 may be supported by one or more conventional mattress cores 620, which are in turn supported by the combination of a base element 630, one or more mechanical drive units 635, and one or more articulated elements 637 (e.g., moving head or foot regions 105 and 106, as in FIG. 1, or an armature 330 as in FIG. 3). A cover 610 encompasses and envelopes the entire assembly. The cover 610 may be sufficiently pliable to allow the movement of all articulated elements 637 without restriction, or may be hinged in one or more locations as appropriate to accommodate movement of different portions of the mattress.

FIG. 6 also depicts a foundation 660 that supports the mattress 640. As shown in FIG. 6 the foundation 660 includes a power supply 680 that in one embodiment includes a battery and a recharging circuit for allowing the battery to be recharged from conventional domestic wall current. The battery may be used for driving a DC motor used to pivot the adjustable mattress from a reclined to an inclined position. A battery charge meter may be built into the foot of the foundation 660 to allow the user to monitor the charge remaining on the battery. In other embodiments where an AC motor is employed, the power supply 680 may include a converter for converting wall current into power suitable for use with the motors in the mattress, which may be three-phase AC motors. In this embodiment, the exterior surface of the mattress will include an electrical coupling, such as an electrical plug, for connecting to the power supply 680. In other embodiments, the power supply 680 may be included directly in the mattress 640.

Figure 7:
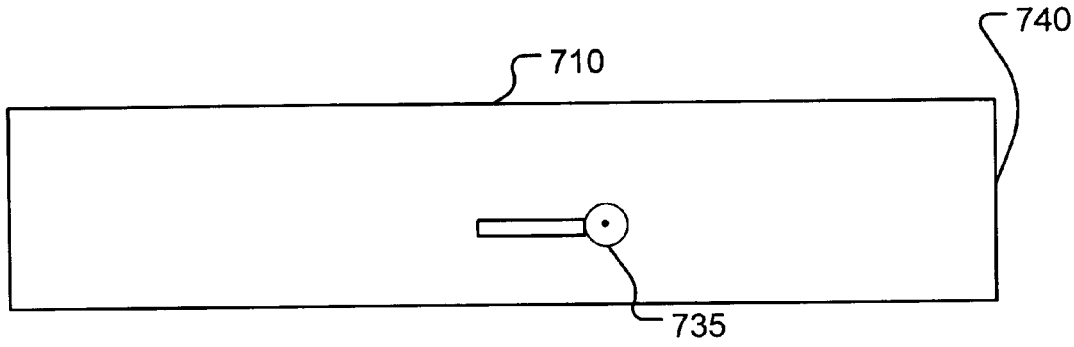
FIG. 7 depicts an alternative embodiment of the invention having a manually operated and powered lift mechanism for pivoting the adjustable mattress into an inclined position.
Figure 8:
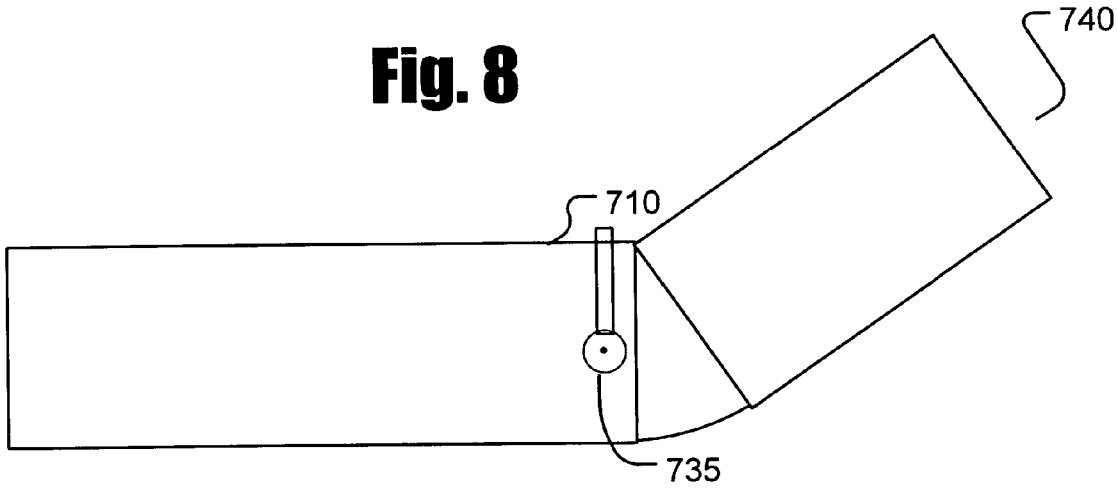
FIG. 8 depicts the alternative embodiment of FIG. 7 in an inclined position.

Turning to FIGS. 7 and 8 an alternative embodiment of the systems described herein is presented. Specifically, in this embodiment the adjustable mattress 710 is manually operated and powered and to this end includes a lift handle mechanism 735 for pivoting the adjustable mattress 710 into an inclined position. One mechanism suitable for use with the mattress 710 is the reclining mechanism described in U.S. Pat. No. 4,573,738 issued to Heesch. As described therein the reclining mechanism includes a gear assembly, one or more coil springs and a clutch spool. When the spring is tensioned, the clutch spool is prevented from rotating and the back support 740 is held from rotational movement about a pivot point. A clutch release plate contacts the spring coil in a manner such that a selected movement of the release plate decreases the coil spring tension on the clutch spool. This permits rotation of the clutch spool and subsequent rotational movement of the back support 740. A similar mechanism is described in U.S. Pat. No. 4,384,744, and either mechanism may be employed with the mattress 710 of FIGS. 7 and 8 without departing from the scope of the invention. In these embodiments, the adjustable mattress may be a one sided mattress having a rigid lower layer to which the reclining mechanism may be mounted. The handle 735 may be employed by the user to adjust the mattress into the desired configuration. In certain embodiments, the user may have to leave the bed or sit up off the back support 740 in order to adjust the mattress 740 into the inclined position.

The mechanical drive units disclosed herein may, in some embodiments, be controlled by wired or wireless controllers. This may include, for example, a dial, knob, slider, or other input selector that provides continuous adjustment over a range of movement so that a user may select an orientation for one or more moveable sections of the adjustable mattress. Similarly, a digital input device such as a touch pad, joystick, or numeric keypad may be used to input desired orientations. Further, a memory may be provided to permit storage of one or more user programmable and/or recallable orientations of one or more moveable portions of the adjustable mattress.

The motors employed with certain of the embodiments described herein may include DC, AC or any other suitable motor or combinations thereof. In these embodiments, the motor selected can depend upon the application and situation at hand, and those of ordinary skill in the art will be able to determine the appropriate motor or motors for the particular circumstance. In those embodiments where AC motors are required, the mattress and optionally the foundation will be modified to allow for a power cord to be attached and connected to a wall outlet. In those embodiments where a DC motor is employed, a power supply may be added to the mattress or built into the foundation. The power supply may comprise and AC/DC converter capable of converting AC power from a wall outlet to DC power for operating the DC motor. Moreover, in certain embodiments the adjustable mattress or a foundation used with the adjustable mattress may include a battery system such as a rechargeable battery system that allows the motor to be operated from the battery power supply. The user may, from time to time and as required, connect an extension cord to the recharging system to recharge the battery. To this end, a battery charge meter may be provided and optionally built into the foundation, such as in the foot of the foundation, or into the mattress to allow the user to determine when the battery system needs to be recharged.

In the designs depicted above, the mattress is designed to present a non-moving bottom surface to a foundation, such as a box spring. It will also be appreciated, however, that the adjustable mattress may include sliders, tracks, wheels, or other friction reducing components along its bottom surface to permit the adjustable mattress to slide over a foundation such as a box spring where, for example, points on two independently moving sections move closer together.

While particular embodiments of the present invention have been shown and described, it will be apparent to those skilled in the art that changes and modifications may be made without departing from the scope of the invention, and therefore, the following claims are to be interpreted in the broadest sense allowable by law.

I claim:

1. An adjustable mattress comprising:

a first section and a second section overlying a common rigid planar platform, with respective upper surfaces of the first section and the second section moveable relative to each other and together forming at least a portion of a sleeping surface of the adjustable mattress;

a first mechanical drive unit within the adjustable mattress, the first mechanical drive unit connected between the platform and at least one of the first section and the second section and providing a mechanical force to move the upper surface of the first section relative to the upper surface of the second section; and a flexible sheet comprising a first sheet member coextensive with the first section and a second sheet member coextensive with the second section and disposed between the first mechanical drive unit and bottom surfaces of the first and second sections, said flexible sheet being continuous in a longitudinal direction of the mattress at least across one of the first and second sections, wherein the first sheet member is attached to the second sheet member by an articulated hinge and a force of the first mechanical drive unit is distributed across a region of the first section by the first sheet member associated with that section.

2. The adjustable mattress of claim 1, further comprising one or more additional sections, each additional section forming a portion of the sleeping surface of the adjustable mattress, and an upper surface of each additional section moveable relative to at least one of the upper surfaces of the first section, the second section, or another one of the one or more additional sections.

3. The adjustable mattress of claim 2, further comprising a second mechanical drive unit within the adjustable mattress and connected to a least one of the additional sections to provide mechanical force to move an upper surface of the at least one additional section relative to the upper surface of the first section, the second section, or another one of the one or more additional sections.

4. The adjustable mattress of claim 3, further comprising an additional sheet member disposed between the at least one additional section and the second mechanical drive unit.

5. The adjustable mattress of claim 1 further comprising a mattress cover enclosing the first section, the second section, the first mechanical drive unit, and the flexible sheet.

6. The adjustable mattress of claim 1 further comprising one or more layers of padding beneath the sleeping surface.

7. The adjustable mattress of claim 1 further comprising a foundation, at least one of the first section or the second section remaining stationary relative to the foundation.

8. The adjustable mattress of claim 1 wherein each of the first section and the second section includes a mattress core adapted to receive the first mechanical drive unit.

9. The adjustable mattress of claim 8 wherein the mattress core of at least one of the first section and the second section includes at least one of a foam core, a liquid core, an air core, a plurality of open spring coils, or a plurality of pocket spring coils.

10. The adjustable mattress of claim 1 further comprising a controller adapted to activate the first mechanical drive unit to move the first section relative to the second section.

11. The adjustable mattress of claim 10 wherein the controller is wireless.

12. The adjustable mattress of claim 10 wherein the controller is programmable to recall one or more positions of the first section relative to the second section.

13. The adjustable mattress of claim 10 wherein the controller provides digital adjustment of the first section relative to the second section.

14. The adjustable mattress of claim 13 wherein the digital adjustment permits entry of a number characterizing the position of the first section relative to the second section.

15. The adjustable mattress of claim 10 wherein the controller provides continuous adjustment of the first section relative to the second section.

16. The adjustable mattress of claim 15 wherein the continuous adjustment includes at least one of a slider, a knob, or a dial.

17. The adjustable mattress of claim 1 wherein the first mechanical drive unit includes a DC motor.

18. The adjustable mattress of claim 1 wherein the first mechanical drive unit includes a worm gear.

19. The adjustable mattress of claim 1 wherein the first mechanical drive unit includes one or more arms coupled to a DC motor.

20. The adjustable mattress of claim 1 wherein the upper surface of at least one of the first section and the second section remains parallel with a ground surface.

21. The adjustable mattress of claim 1 wherein the first section is at least one of a head section of a mattress or a foot section of a mattress.

22. The adjustable mattress of claim 1, wherein the first and second sheet members are made of a continuous piece of plywood.

23. The adjustable mattress of claim 1, wherein the first and second sheet members are made of a continuous piece of plastic.

24. The adjustable mattress of claim 1, wherein the flexible sheet is sized to match the sleeping surface.

25. An adjustable mattress comprising:

a first section and a second section overlying a common rigid planar platform, with respective upper surfaces of the first section and the second section moveable relative to each other and together forming a sleeping surface of the adjustable mattress;

a mechanical means within the adjustable mattress for moving the upper surface of the first section relative to the upper surface of the second section; and a flexible mid-sheet comprising a first sheet member coextensive with the first section and a second sheet member coextensive with the second section and disposed between the mechanical means and the first and second sections, said flexible mid-sheet being continuous in a longitudinal direction of the mattress at least across one of the first and second sections, wherein the first sheet member is attached to the second sheet member by an articulated hinge and a force of the mechanical means is distributed across a region of the first section by the first sheet member coextensive with that section.

26. An articulated mattress having a flexible cover, comprising:

a base element forming a planar region parallel to a sleeping surface of said mattress;

a sleeping element comprising:

a first section and a second section with respective upper surfaces of the first section and the second section moveable relative to each other and together forming the sleeping surface of the mattress;

one or more mattress cores disposed on and above a flexible sheet, said flexible sheet comprises a first sheet member coextensive with the first section and a second sheet member coextensive with the second section, the first sheet member is attached to the second sheet member by an articulated hinge, and the flexible sheet is continuous in a longitudinal direction of the mattress at least across one of the first and second sections; and articulation means fixedly attached to said base element, comprising a screw drive means fixedly mounted to said base element; and linkage means coupled to said screw drive, whereby actuation of said screw drive causes said linkage to bear on said flexible sheet, thereby displacing said sheet;

wherein the screw drive is distributed across a region of the corresponding one of the first and second sections by the first or second sheet member associated with that section, and wherein said base element, said sleeping element, said articulation means, and said flexible sheet are located within said flexible cover.

27. The articulated mattress of claim 26, wherein said mattress overlaps a frame, said mattress further comprising one or more clamping means for attaching said mattress to said frame.

28. The articulated mattress of claim 26, wherein said articulation means further comprises a controller configured to effect said actuation.

29. The articulated mattress of claim 28 wherein said controller is a wireless controller.

* * * * *